United States Patent [19]

Wischusen

[11] 4,156,484

[45] May 29, 1979

[54] SELF-STABILIZING TRAY AND BLANK

[75] Inventor: Henry F. Wischusen, Tuscaloosa, Ala.

[73] Assignee: Winchester Carton Corporation, Wilmington, Mass.

[21] Appl. No.: 878,770

[22] Filed: Feb. 17, 1978

[51] Int. Cl.[2] ..... B65D 5/48; B65D 1/34

[52] U.S. Cl. ..... 206/563; 206/565; 229/27; 229/30

[58] Field of Search ..... 229/15, 27, 28 R, 30; 206/561, 562, 563, 564, 565, 45.19; 224/46 T, 48 R

[56] References Cited

U.S. PATENT DOCUMENTS

| | | | |
|---|---|---|---|
| 2,640,589 | 6/1953 | Foster et al. | 206/562 |
| 3,140,035 | 7/1964 | Wenzel | 206/562 |
| 3,149,770 | 9/1964 | Spillson | 206/562 |
| 3,181,770 | 5/1965 | Coe | 229/30 |
| 3,434,650 | 3/1969 | Goings | 206/563 |
| 3,722,781 | 3/1973 | Page | 229/28 R |

*Primary Examiner*—Herbert F. Ross
*Attorney, Agent, or Firm*—Kenway & Jenney

[57] ABSTRACT

A disposable, self-stabilizing tray, which is shipped in a flat condition and which forms a stable, non-collapsible structure as it is being erected, is disclosed. The tray includes a transverse downwardly directed panel partition which extends between the top and bottom panel members, and which, as the tray is being erected, cams a longitudinal panel into a downwardly directed direction. A protrusion or projection from the longitudinal panel is thus cammed into a locking notch which is formed by a recessed shoulder of an opening in the bottom member of the tray. An integral blank useful for constructing the tray is also disclosed.

9 Claims, 3 Drawing Figures

SELF-STABILIZING TRAY AND BLANK

The invention relates generally to disposable trays and in particular to a self-stabilizing, non-collapsible tray which is shipped in a flat condition.

BACKGROUND OF THE INVENTION

The growth of take-out food restaurants, and especially the fast-food chains, in the United States and abroad has brought about an unprecedented demand for the disposable trays which are used to carry food and beverages from the food dispensing area to either a table within the restaurant or to another location, for example, an automobile. After that single use, the trays are thrown away and are not used again.

A prime requirement for the disposable tray is that it be inexpensive. In order to maintain a low cost per tray, the trays are manufactured from an integral blank and are shipped in a folded or collapsed condition. There exist today many different constructions of trays which can be shipped in a flattened condition, which are erected just prior to use, and which meet the requirements of both adequate stability and low cost. Just prior to use, the prior art trays are erected by forming a three-dimensional structure and folding one or more panels to provide locking support against collapse during use.

Unfortunately, the requirement of folding one or more panels to provide the tray with the stability needed to withstand the weight of food and beverage creates an extra step to be performed by restaurant personnel and hence effectively adds to the cost of the tray. It also provides an additional opportunity for error and accidental spillage if the panels are not folded correctly.

It is therefore an object of this invention to provide a tray which forms a self-stabilizing non-collapsible structure as it is being erected, which can be shipped in a flattened condition, which is low in cost, which is simple to manufacture, and which can be formed from an integral blank. Other objects of the invention include the provision of a tray which can be constructed from an integral blank of fibrous material and which requires no skill to erect.

It is another object of the invention to provide an integral blank which can be cut and assembled to form a self-stabilizing, non-collapsible structure.

SUMMARY OF THE INVENTION

The self-stabilizing serving tray of the invention is formed from an integral blank and forms a stable structure as it is erected. The tray features a bottom member having at least one protrusion receiving opening, spaced apart upright side wall members, each side wall member hingedly connected to and extending from the bottom member, and a top member hingedly connected to and extending from each of the side wall members. The top member has at least one pair of downwardly directed, hingedly connected, panels extending to said bottom member. One panel of each panel pair is hingedly connected to the bottom member along an adhesive connection and is directed substantially parallel to the side walls. The other panel of each panel pair extends substantially normal to the first panel of the panel pair in an abutting relationship thereto and has a tab protrusion or projection extending through the bottom member at a recessed shoulder of the respective protrusion receiving opening of the bottom member.

The opening is sufficiently large and so positioned to provide a path of substantially non-interfering or unobstructed travel for the tab protrusion as the tray is being erected. The first panel, by the abutting relationship, maintains the protrusion in the recessed shoulder.

The integral blank for a self-stabilizing serving tray which forms a stable structure as it is being erected from an assembled, collapsed state features a plurality of connected panel members comprising a top panel member, side wall panel members extending from the top panel member and being connected to the top panel member along score lines, and end panels extending respectively from the side panel members and being connected to the side panel members along score lines, the end panels together forming a bottom member of the assembled serving tray. At least one of the end panels has at least one protrusion receiving opening, each opening including a recessed shoulder portion. The top panel member includes at least one pair of panel sections, each pair comprising a longitudinally extending panel section and a transversely extending panel section. Each longitudinally extending panel section is connected to the top panel member along a longitudinally extending score line and has a tab protrusion or projection extending therefrom away from the score line in a transverse direction. Each transversely extending panel section is connected to the top panel member along a score line extending transversely from the longitudinal score line of the longitudinal panel section of which it is a pair. The transversely extending score line extends away from the longitudinal score line in a direction away from the protrusion. The blank further features at least one panel flap portion connected to said blank along a transverse score line for hingedly connecting a corresponding transverse panel section to the bottom member. Thereby, the transverse panel section cams the correspondingly related longitudinal panel section into a substantially upright condition when the tray is erected and simultaneously, the tab protrusion, is directed toward, and in the erected state rests in, the recessed shoulder.

DESCRIPTION OF THE DRAWINGS

Other objects, features, and advantages of the invention will appear from the following description of the preferred embodiment of the invention taken in connection with the drawings in which.

DESCRIPTION OF A PREFERRED EMBODIMENT

Figure 1:
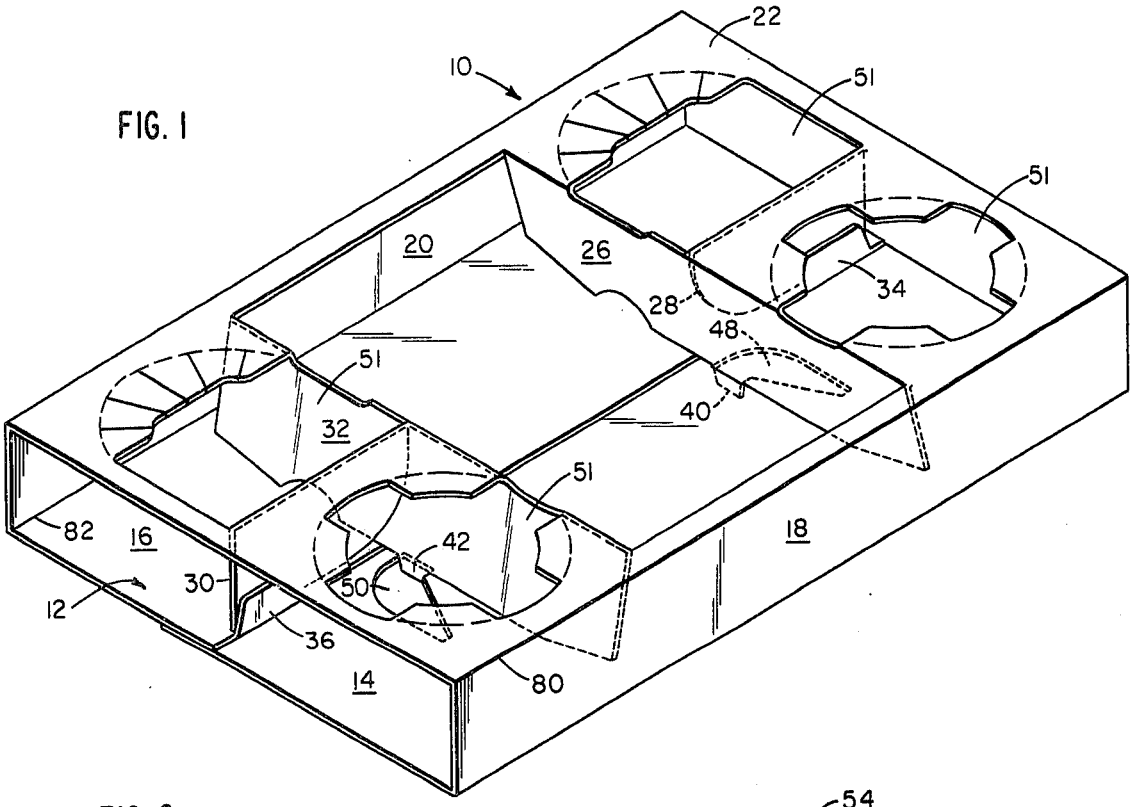
FIG. 1 is a perspective view of a serving tray constructed according to the invention, in its upright, non-collapsible, condition.

Referring to FIG. 1, a serving tray 10 constructed according to the invention, has a bottom member 12 comprised of two end panels 14, 16, side wall panel members 18, 20, and a top panel member 22. The side wall members are spaced apart the entire length of the tray and are hingedly connected to and extend from the bottom member 12. The top member 22 is hingedly connected to and extends from each of the side wall members.

The top member 22 has two pairs of downwardly directed cooperating panels 26, 28 and 30, 32. A smaller or greater number of panel pairs could be used. Each of panels 26, 28, 30, 32 is hingedly connected to and extends from the top member. Panels 28 and 30 extend in a transverse direction (relative to the blank from which tray 10 is assembled) and are connected to the bottom member 12 by an adhesive connection to flaps 34, 36 respectively. Flaps 34 and 36, in the illustrated embodiment, are hingedly connected to end panel 16 and thus provide panels 28 and 30 with the hinged connections to bottom member 12. Panels 26 and 32 each extend in a longitudinal direction, downwardly from the top member, and contact bottom member 12, in this embodiment, along a substantial portion of their length. Each panel 26, 32 has a tab protrusion or projection 40, 42 extending through the bottom member 12 at a recessed shoulder 44, 46 (FIG. 2), respectively, of protrusion receiving elbow configurated openings 48, 50 of the bottom member. The top panel member 22 also has a plurality of openings 51 for receiving and holding food and beverages. Bottom panels 14 and 16 are connected preferably along a line of adhesive 52 (FIG. 2).

Figure 2:
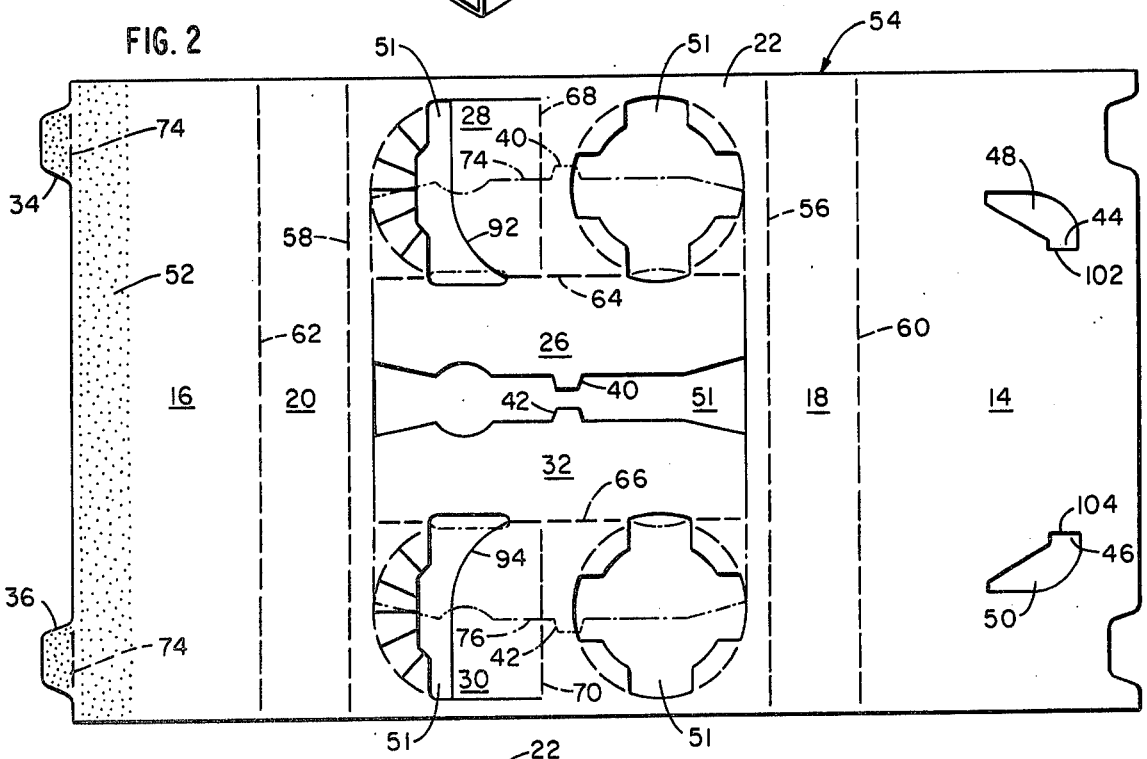
FIG. 2 is a plan view of the blank used to construct the tray of FIG. 1.

A blank 54 from which the tray 10 can be assembled is shown in detail in FIG. 2. Like reference numerals have been applied in FIGS. 1 and 2 to denote similar panels or members. According to the preferred embodiment, the top panel member 22 is a centrally located member from which side wall panel members 18 and 20 extend longitudinally. Side wall panels 18 and 20 are connected to the top panel along score lines 56 and 58 respectively. The end panels 14 and 16 which together form bottom member 12 of the assembled serving tray extend from and are connected to the side panels along score lines 60 and 62 respectively. Illustrated panel member 14 contains the elbow openings 48 and 50 which include the recessed shoulder portions 44 and 46 respectively.

Panels 26 and 32, which extend longitudinally of the blank, are each connected to the top panel along longitudinally extending score lines 64, 66 respectively. The panels 28 and 30 are connected to top panel member 22 along transversely extending score lines 68 and 70 respectively and extend transversely of the blank 54. Illustrated connecting flap panels 34, 36 extend from and are connected to end panel 16 along score lines 74.

The tray 22 may be assembled from blank 54 by first longitudinally folding extending panels 26 and 32 along their score lines 64 and 66 back upon panel 22 (into the plane of FIG. 2), until they assume the position shown by dotted lines 74, 76 respectively. While holding panels 26 and 32 in this position, the end panels 14 and 16 are folded into the plane of FIG. 2 along score lines 56 and 62 respectively, until they meet and are connected along a glue line represented by the shaded portion 52 on panel 16. The end panels 14 and 16 overlap enough so that flaps 34 and 36, which are coated with an adhesive prior to folding end panel 16 are each adhesively connected to a portion of the underside (looking at FIG. 2) of panels 28 and 30 respectively. The adhesive is set and the carton is ready for shipment (and subsequent use) in its flat, folded condition.

Figure 3:
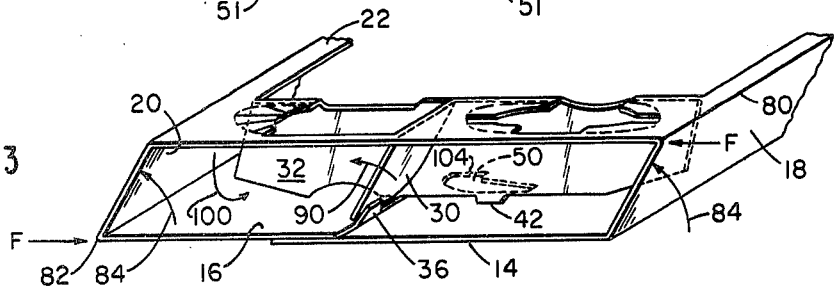
FIG. 3 is a fragmentary end view, in perspective, showing the forces and motions at play as the serving tray is being erected.

Referring to FIG. 3, the carton is erected from the collapsed state by applying a force F along edges 80 and 82 (which correspond to score lines 56 and 62 respectively). As a result, the carton begins to pivot upwardly (arrows 84) toward an erect position. As the carton becomes erect, transverse panels 28 and 30, which are connected between the top and bottom members, pivot about their upper and lower hinged connections, toward an upright position. This is indicated by arrow 90. As panels 28 and 30 pivot towards the upright position, their curved corner edges 92 and 94 respectively, which are cut to maintain an abutting relationship to panels 26 and 32 respectively while the tray is being erected, urge panels 26 and 32 to pivot downwardly toward an upright position. Thus, transverse panels 28 and 30 effectively cam longitudinal panels 26 and 32 to an upright position. As panels 26 and 32 pivot around score lines 64 and 66 respectively to an upright position (as indicated by arrow 100 (FIG. 3)), the protrusions 40, 42 move or travel in a substantially unobstructed arc or path around the score lines 64, 66, downwardly towards the bottom end panel 14. The openings 48, 50 are positioned in panel 14 to provide protrusions 40, 42 with a substantially unobstructed path. As the protrusions 40, 42 reach the bottom panel, they pass through the panel into openings 48, 50 and come to rest in shouldered recesses 44, 46. When the tray has assumed its full upright position, protrusions or projections 40, 42 are fully cammed against end walls 102, 104 of openings 48, 50 respectively, The protrusions 40, 42 are thus effectively "locked" in place against either a transverse or longitudinal displacement force: movement in the transverse direction is prevented by the camming action of panels 28, 30 (and in particular arcuate corners 92, 94) against panels 26, 32 respectively, and movement in the longitudinal direction is effectively restricted by the side walls of shoulder recesses 44, 46 against protrusions 40, 42 respectively.

In a particular embodiment of the invention, the blank 52 is comprised of a fibrous cardboard material as is well known in the art. The blank 52 is prepared as is well known in the art and is assembled in a flat condition prior to shipment. Thus, there is provided a serving tray which is shipped in a collapsed form, and which requires only a single motion to erect it to its full three dimensional form. Once erected, the tray is self-supporting and will not collapse during use.

Other embodiments of the invention including any additions, subtractions, deletions, or modifications to the disclosed preferred embodiment of the invention will be obvious to one skilled in the art and are within the ambit of the following claims.

What is claimed is:

1. A self-stabilizing serving tray formed from an integral blank, and which forms a stable structure as it is erected comprising a bottom member having at least one protrusion receiving elbow configurated opening, spaced apart, upright side wall members, each side wall member hingedly connected to and extending from said bottom member, a top member hingedly connected to and extending from each of said side wall members, said top member having at least one pair of downwardly directed, hingedly connected, panels extending to said bottom member, one panel of each panel pair being connected to said bottom member along an adhesive connection for hinged movement and being directed substantially parallel to said side walls, the other panel of each panel pair extending substantially normal to said one panel of said respective panel pair in an abutting relationship thereto and having a tab protrusion extending through said bottom member at a recessed shoulder of a respective protrusion receiving opening in the bottom member, each said opening being sufficiently large and so positioned to provide a path of substantially unobstructed travel for said tab protrusion as the tray is being erected, and said one panel by said abutting relationship maintaining said protrusion in said recessed shoulder.

2. The serving tray of claim 1 wherein there are at least two pairs of downwardly directed panels.

3. The serving tray of claim 1 wherein said recessed shoulder is recessed in a direction parallel to said side walls, and has a width in a direction normal to said side walls, said width being substantially equal to the width of said protrusion.

4. The serving tray of claim 1 wherein said one of each panel pair has an arcuate corner section terminating at each corner edge in substantially straight line edge portions, one of said edge portions being connected to said bottom member for hinged movement and at least a portion of the other of said edge portions being in abutting contact with said other panel of said panel pair.

5. An integral blank for a self-stabilizing serving tray which forms a stable structure as it is erected from an assembled, collapsed state comprising a plurality of connected panel members comprising a top panel member, side wall panel members extending from said top panel member and being connected to the top panel member along score lines, and end panels extending respectively from the side panel members, being connected to the side panel members along score lines, and said end panels together forming a bottom member of the assembled serving tray, at least one of said end panels having at least one protrusion receiving elbow configurated opening, each said opening including a recessed shoulder portion, said top panel member including at least one pair of panel sections, each pair comprising a longitudinally extending panel section and a transversely extending panel section, each said longitudinally extending panel section being connected to the top panel member along a longitudinally extending score line and having a tab protrusion extending from said panel in a transverse direction and away from said score line, each said transversely extending panel section being connected to the top panel member along a score line extending transversely from the longitudinal score line of the longitudinal panel section of the pair and in a direction away from said protrusion, and said blank including at least one panel flap portion connected to said blank along a transverse score line, each flap for hingedly connecting one said transverse panel section to said bottom member, whereby said transverse panel section cams the corresponding related longitudinal panel section into a substantially upright condition when said tray is erected and each said protrusion rests in corresponding recessed shoulder when said blank is assembled and erect.

6. The blank of claim 5 wherein each of said transverse panel sections has an arcuate cut corner on a side closest to said corresponding longitudinal score line.

7. The blank of claim 5 wherein said shoulder recess has an end edge which, when extended, intersects a corresponding transverse panel section.

8. The blank of claim 5 wherein said transverse panel sections have a maximum longitudinal width approximately equal to the longitudinal width of said side walls.

9. The blank of claim 5 wherein said openings are positioned in the bottom panel for providing said protrusions with a substantially unobstructed path of travel when said tray is erected.

* * * * *